US011517785B1

(12) United States Patent
Nolan

(10) Patent No.: US 11,517,785 B1
(45) Date of Patent: Dec. 6, 2022

(54) EXERCISE MACHINE SYSTEM AND METHOD OF USE

(71) Applicant: Nicole Nolan, Houston, TX (US)

(72) Inventor: Nicole Nolan, Houston, TX (US)

( * ) Notice: Subject to any disclaimer, the term of this patent is extended or adjusted under 35 U.S.C. 154(b) by 0 days.

(21) Appl. No.: 17/034,950

(22) Filed: Sep. 28, 2020

(51) Int. Cl.
*A63B 21/00* (2006.01)

(52) U.S. Cl.
CPC ..... *A63B 21/4035* (2015.10); *A63B 21/156* (2013.01); *A63B 21/4047* (2015.10)

(58) Field of Classification Search
CPC ..... A63B 21/0407; A63B 21/0414; A63B 21/078; A63B 21/151; A63B 21/152; A63B 21/154; A63B 21/156; A63B 21/159; A63B 21/4017; A63B 21/4035; A63B 21/4045; A63B 21/4047; A63B 21/4049; A63B 2225/09; A63B 21/0615; A63B 21/0616; A63B 21/0617; A63B 21/0618; A63B 21/08; A63B 21/00058; A63B 21/00061; A63B 21/00065
See application file for complete search history.

(56) References Cited

U.S. PATENT DOCUMENTS 5,788,614 A * 8/1998 Simonson ..... A63B 23/1254 482/134
6,238,323 B1 * 5/2001 Simonson ..... A63B 21/156 482/102
6,488,612 B2 * 12/2002 Sechrest ..... A63B 21/152 482/138
6,905,446 B2 * 6/2005 Greenland ..... A63B 21/06 482/100
7,918,771 B2 * 4/2011 Rogers ..... A63B 21/0615 482/100
11,013,945 B2 * 5/2021 Sorin ..... A63B 21/00072
11,173,337 B2 * 11/2021 Jones ..... A63B 21/0616
2017/0056707 A1 * 3/2017 Hockridge ..... A63B 21/156
2019/0269963 A1 * 9/2019 Steenekamp ..... A63B 21/0616

FOREIGN PATENT DOCUMENTS

WO WO-2019199352 A1 * 10/2019 ..... A63B 21/156

* cited by examiner

*Primary Examiner* — Megan Anderson
(74) *Attorney, Agent, or Firm* — Leavitt Eldredge Law Firm

(57) ABSTRACT

An exercise system includes a frame having a vertical post with adjustment holes extending therethrough; a lever arm attached to the vertical post via a carriage, the carriage to adjust up and down via the adjustment holes; the carriage having a brace creating a channel to engage with the post; a pivoting system extending from the brace, the pivoting system having a side to side pivoting connection attached to a second brace, the side to side pivoting connection allowing for the second brace to pivot horizontally; a rotating connection attached to the second brace via a first plate and the lever arm via a second plate, the rotating connection allowing for rotational movement of the lever arm; the carriage allows for the lever arm to be adjusted vertically, from side to side, and in a pivoting direction as needed for attachment of one or more exercise attachments.

7 Claims, 6 Drawing Sheets

EXERCISE MACHINE SYSTEM AND METHOD OF USE

BACKGROUND

1. Field of the Invention

The present invention relates generally to exercise machines, and more specifically, to an exercise machine system that allows for incorporation of a plurality of attachments and a plurality of configurations, thereby allowing for the user to utilize one machine for a multitude of exercises.

2. Description of Related Art

Exercise machines are well known in the art and are effective means to provide various functions for the user to engage in one or more exercises. For example, FIG. 1 depicts a conventional exercise system 101 having a frame 103 configured to support an arm 105 with a handle 109, the arm 105 being pivotally connected 107 to the frame. During use, the user may add weight and/or resistance while utilizing arm 105.

One of the problems commonly associated with system 101 is limited use. For example, the user can only perform a limited number of exercises with the system. The user will then move on to another apparatus or machine to complete additional exercises.

Accordingly, although great strides have been made in the area of exercise machine systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
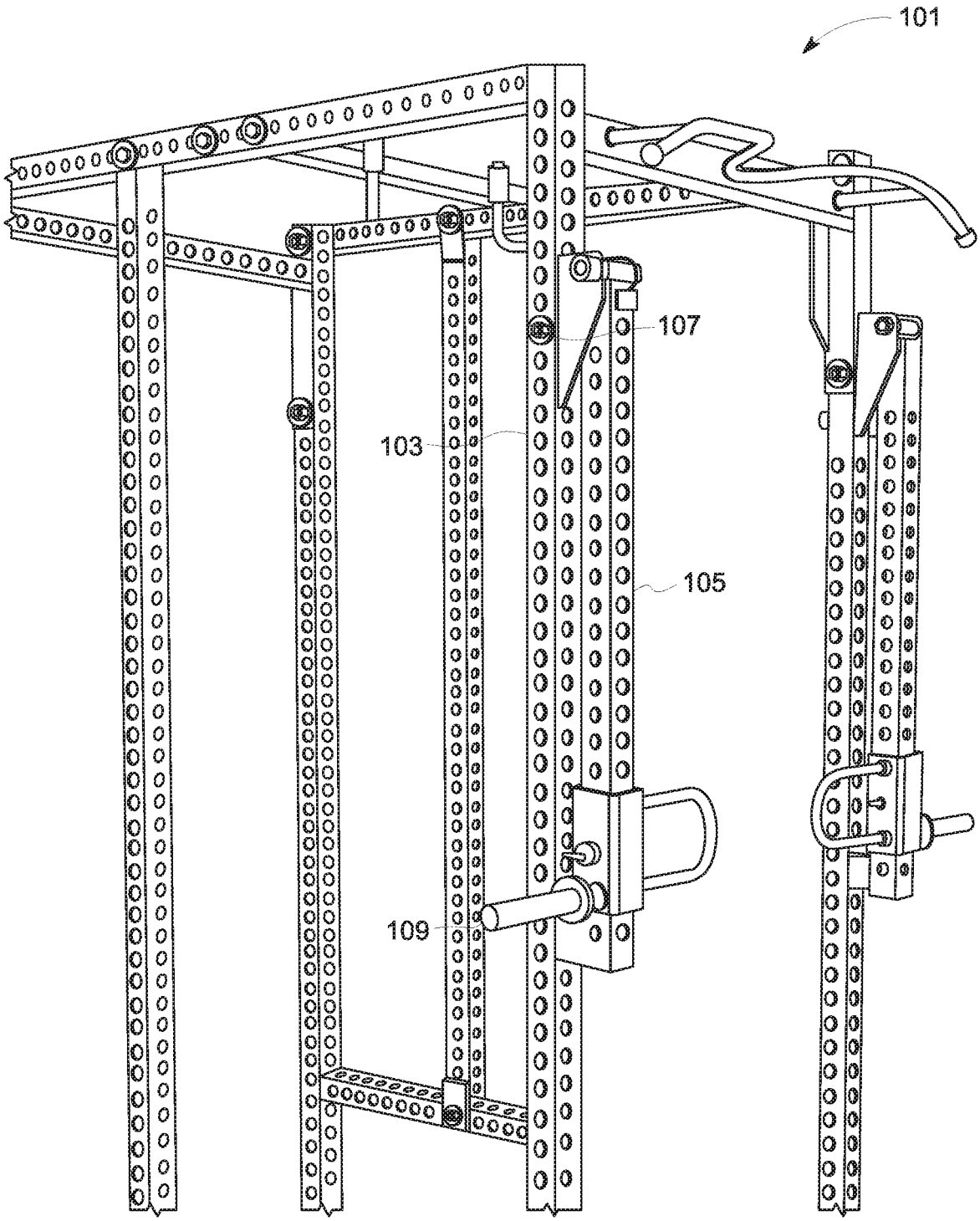
FIG. 1 (PRIOR ART)
FIG. 1 is an isometric view of a common exercise machine system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise machine systems. Specifically, the present invention provides for an exercise machine system that utilizes a carriage that provides for multi-directional movement of an arm, as well as a plurality of attachment systems to allow for various device attachments, these features allowing a user to manipulate the machine as needed for a multitude of exercises. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
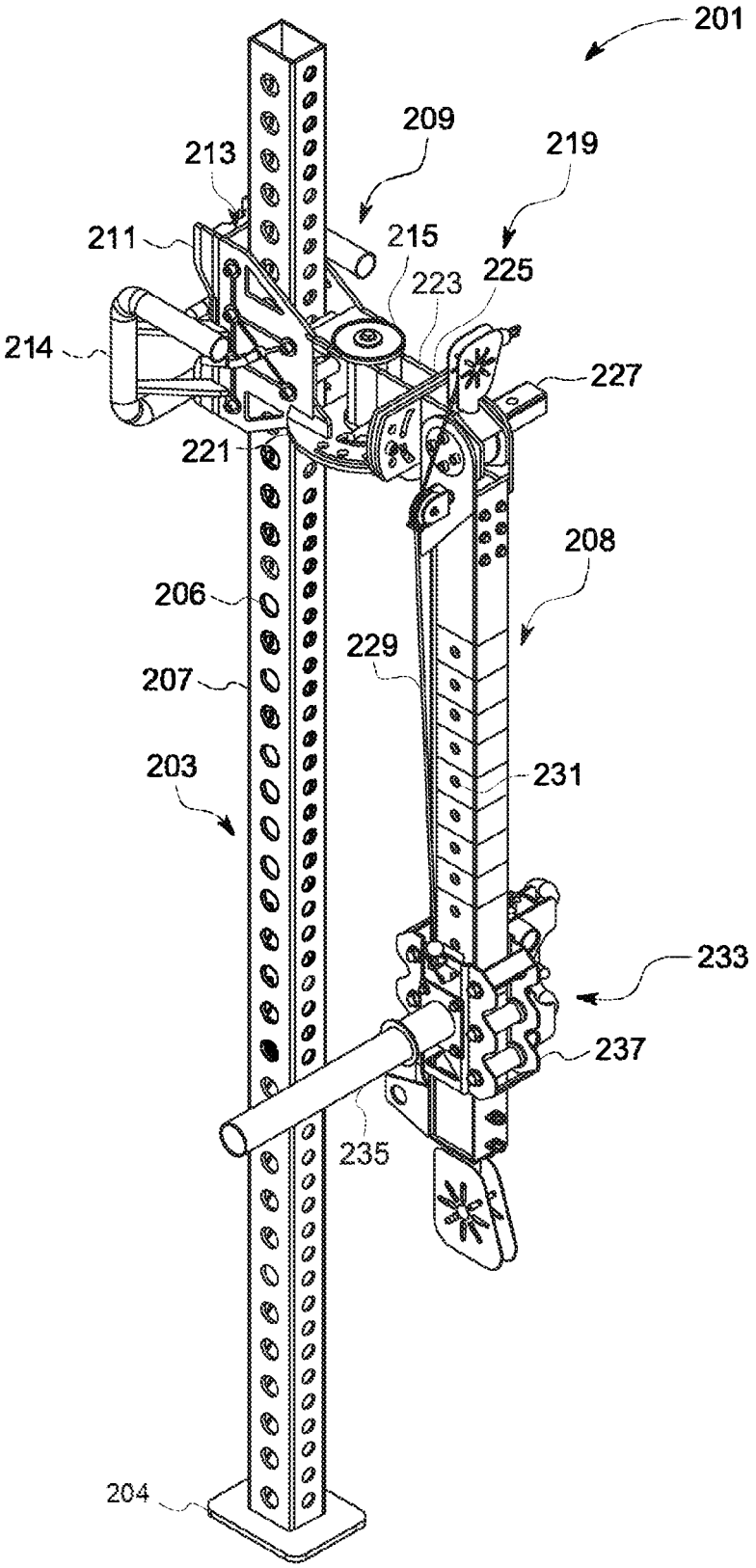
FIG. 2 is an isometric view of an exercise machine system in accordance with the present application.

Referring now to the drawings wherein like reference characters identify corresponding or similar elements throughout the several views, FIG. 2 depicts an isometric view of an exercise machine system 201 in accordance with a preferred embodiment of the present application. It will be appreciated that system 201 overcomes one or more of the above-listed problems commonly associated with conventional exercise systems.

In the contemplated embodiment, system 201 includes a frame 203 that includes one or more vertical posts 207 extending from one or more supports 204. It should be appreciated that the system preferably includes a second system that mimics the system discussed herein, thereby providing at least two arms for use. Further, the frame may vary as functional, manufacturing, or aesthetical considerations require.

The vertical post 207 will include a plurality of adjustment holes 206 extending therethrough, thereby providing for adjustability. System 201 further includes a lever arm 208 attached to the vertical post via a carriage 209, the carriage configured to adjust up and down via the plurality of adjustment holes and including one or more handles 214 for easy user manipulation. It should be appreciated that one of the unique features believed characteristic of the present application is the carriage, which provides for various manipulation of the lever arm 208, thereby providing for various configurations and uses.

In the preferred embodiment, the carriage 209 includes a brace 211 creating a channel 213 to engage with the post. Further, a pivoting system 219 extends from the brace, the pivoting system having a side to side pivoting connection 215 attached to a second brace 223, the side to side pivoting connection allowing for the second brace to pivot about a vertical axis, thereby allowing for horizontal movement of the lever arm 208. In addition, a rotating connection 225 is attached to the brace 223 which provides for the lever arm to pivot from side to side.

It should be appreciated that the carriage 209 allows for the lever arm 208 to be adjusted vertically, from side to side, and in a pivoting direction as needed for attachment of one or more exercise attachments. This should be considered one of the unique features believed characteristic of the present application.

The system further includes a grip system 233 which includes an attachment device 237 to attach to the lever arm 208 and a grip 235 for user manipulation. The lever arm 208 may include adjustment holes 231 for additional adjustability.

Additional features shown and contemplated in FIG. 2, include a cable system 229 which provides for attachment and manipulation of various devices that can be used for various exercises. In addition, one or more protrusions 227 extend from the lever arm for such engagement as well.

Because of the various adjustments that can be performed via the carriage, the system is suitable for adding attachment devices that can provide a number of exercises. The use of the attachments can go on to perform a plurality of movements such as decline chest press, chest press, incline chest press, military press, all variations of lat pulling and rowing movements, dips, and more. A leg press foot plate attachment allows for the lever arms to dock to become a 45 degree leg press unlike anyone has ever been able to do. The foot plate attachment also can swivel to allow arms to become a vertical leg press or be paired with the leverage arm and then do all leverage leg press moves as well as taking place of a plurality of conventional machines. The shoulder full back pad attachment allows arms to become a pendulum squat machine by using a foot plate. That same attachment used in other ways can allow arms to become a hack squat, hip sled, V squat. A shoulder pad attachment allows the arms to become a squat pro machine. A tri axis single handle attachment can be used to perform many of the above mentioned moves and more by allowing ultimate adjustability for the handle to conform to almost any lever, leverage, or smith machine movement. The counter balance cable attachment allows the leverage arm and its carriage to attach to the lever arms cable and then become a counterbalance to perform all counter balance exercises like assisted pull-ups or dips. Cushion pads attachment can be used to make arms into leg extension, leg curl, low back extension, seated Ab machine and more. Curved bar attachment can make arms into a preacher curl, over head tricep extension, and more. A Smith straight bar allows arms to use carriage system to be used as a smith machine. Single handles can be used to perform unilateral smith type functions as well as unilateral lever and leverage moves. This design can also be modified to use stack weight and cable it allows the same movements and machine functions but no plate weights needed.

During operation of the exercise machine system, the user would add on a desired attachment and perform a desired exercise. As needed, the user can switch out attachments and continue with their workout.

Figure 3:
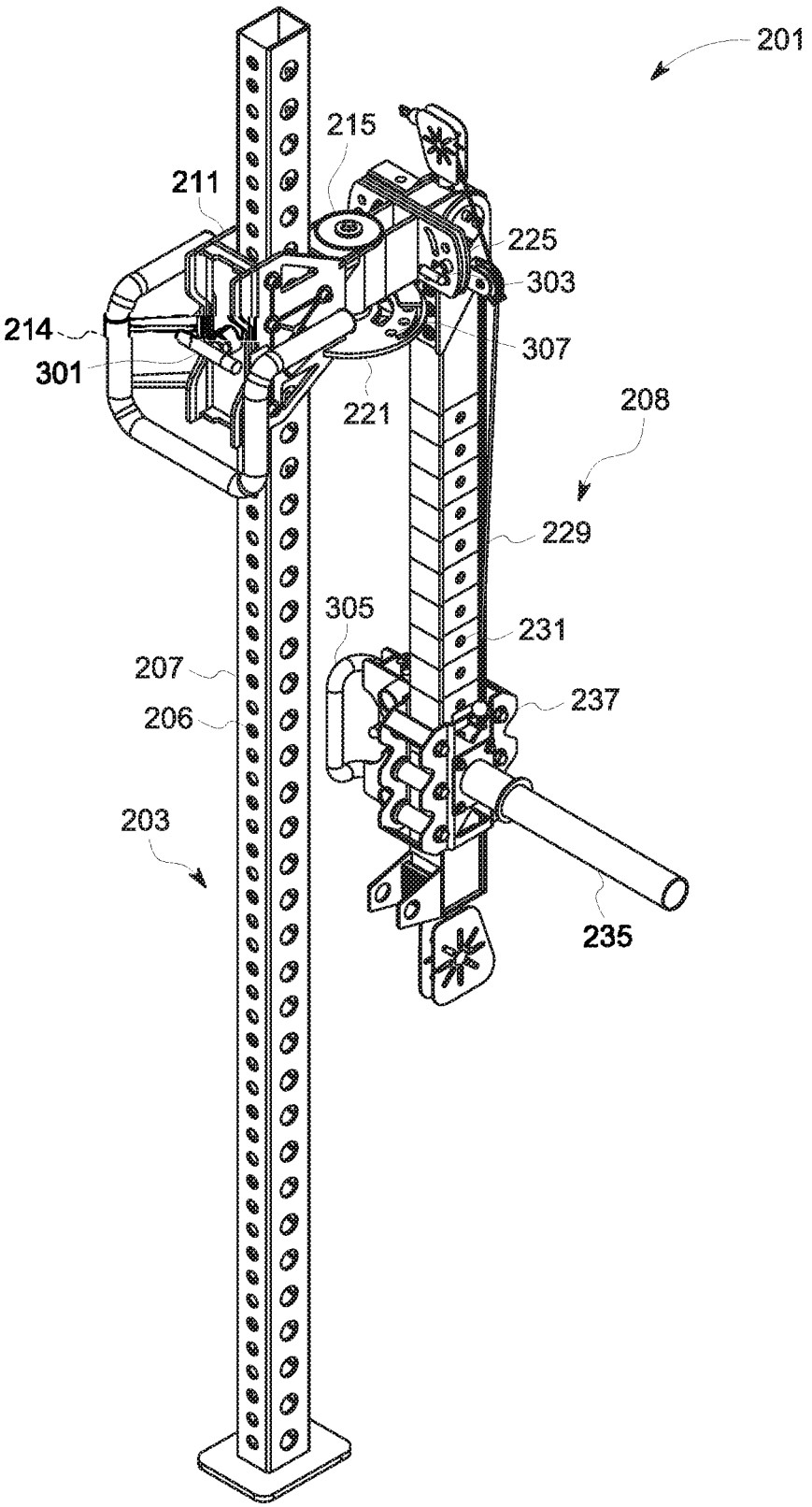
FIG. 3 is a second isometric view of the system of FIG. 2.

In FIG. 3, another isometric view of system 201 is shown for clarity. As shown, the carriage will include a knob 301 that extends through the bracket 211 and into the vertical post 207, thereby securing the carriage at a desired location. Further shown in this figure is a second handle 305 that is part of the grip system to provide for easy user manipulation.

Figure 4:
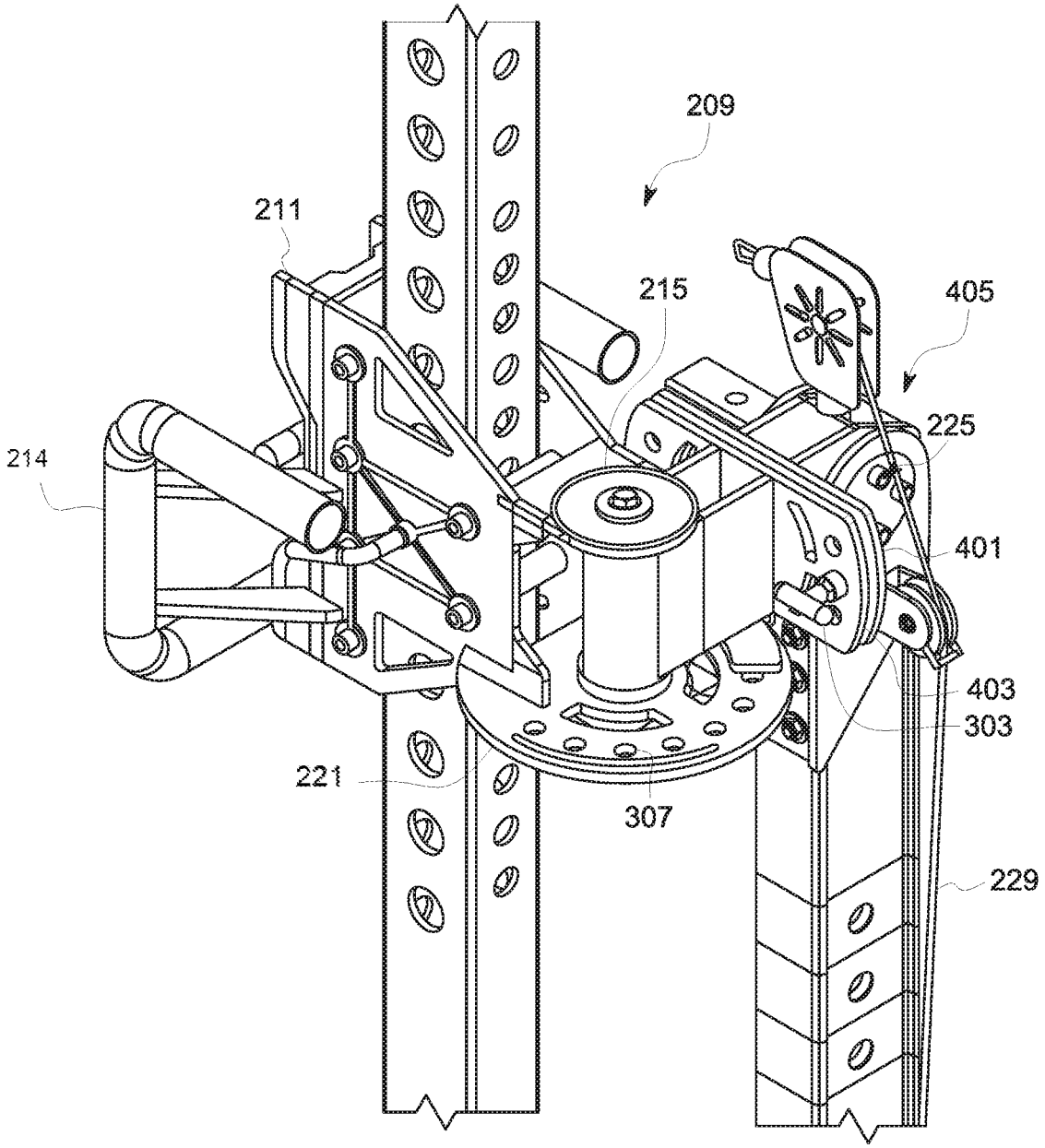
FIG. 4 is a close up view of a carriage of the system of FIG. 2.
Figure 5:
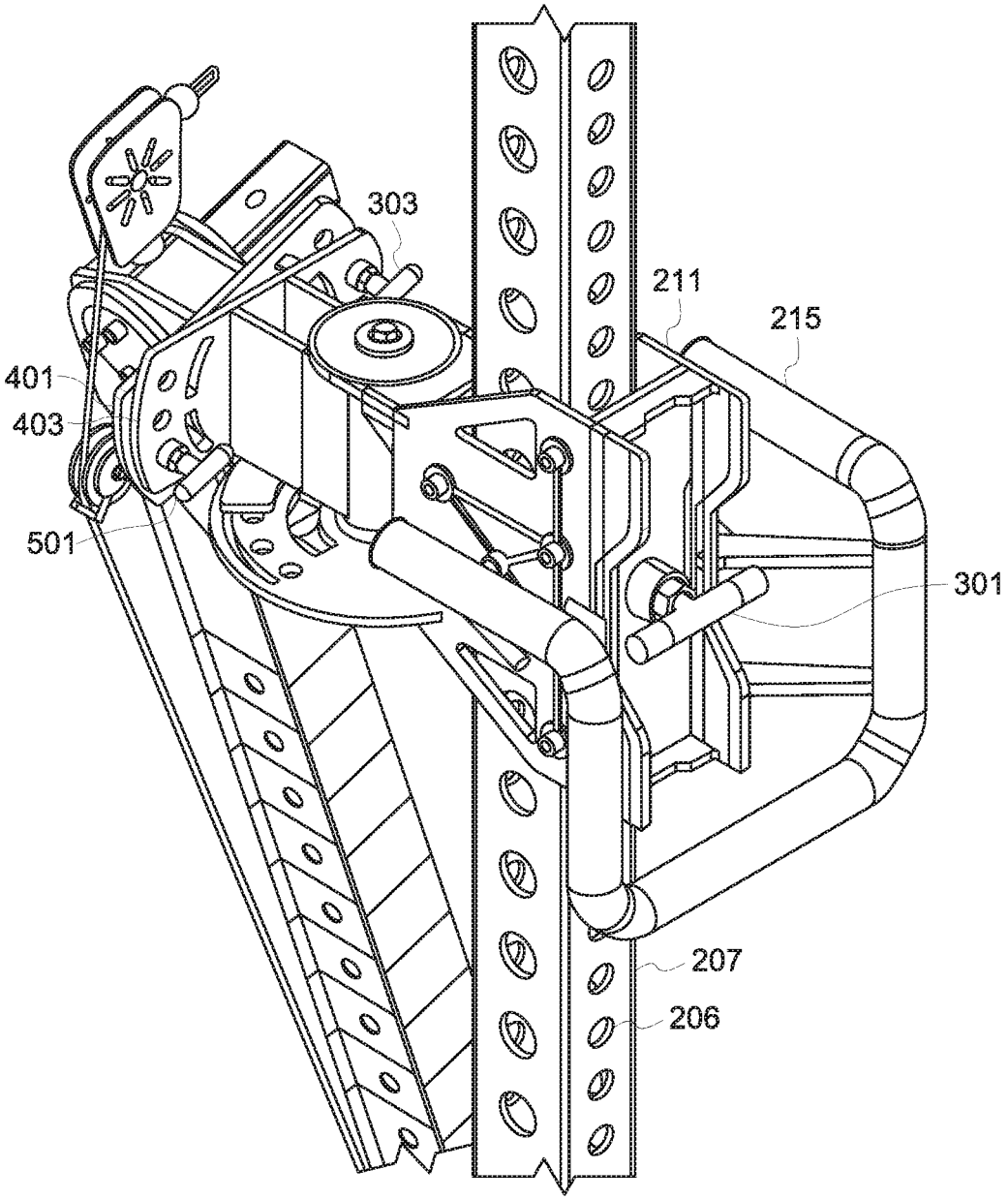
FIG. 5 is a second close up view of the carriage of the system of FIG. 2.

In FIG. 4, a closer view of the carriage is shown. As shown, the lever arm is in a shifted position via the side to side pivoting connection 215. As shown, a bottom disk 221 with one or more holes 307 allows for movement about the vertical axis to a desired location. As further shown, the rotating connection includes a first plate 401 and second plate 403 that pivot relative to one another and secure in place via a second knob 303. This rotational movement being depicted in FIG. 5. As further shown, the cable system 229 may include a top cable support 405. In FIG. 5, another knob 501 is shown that secures the lever arm in a pivoted position.

Figure 6:
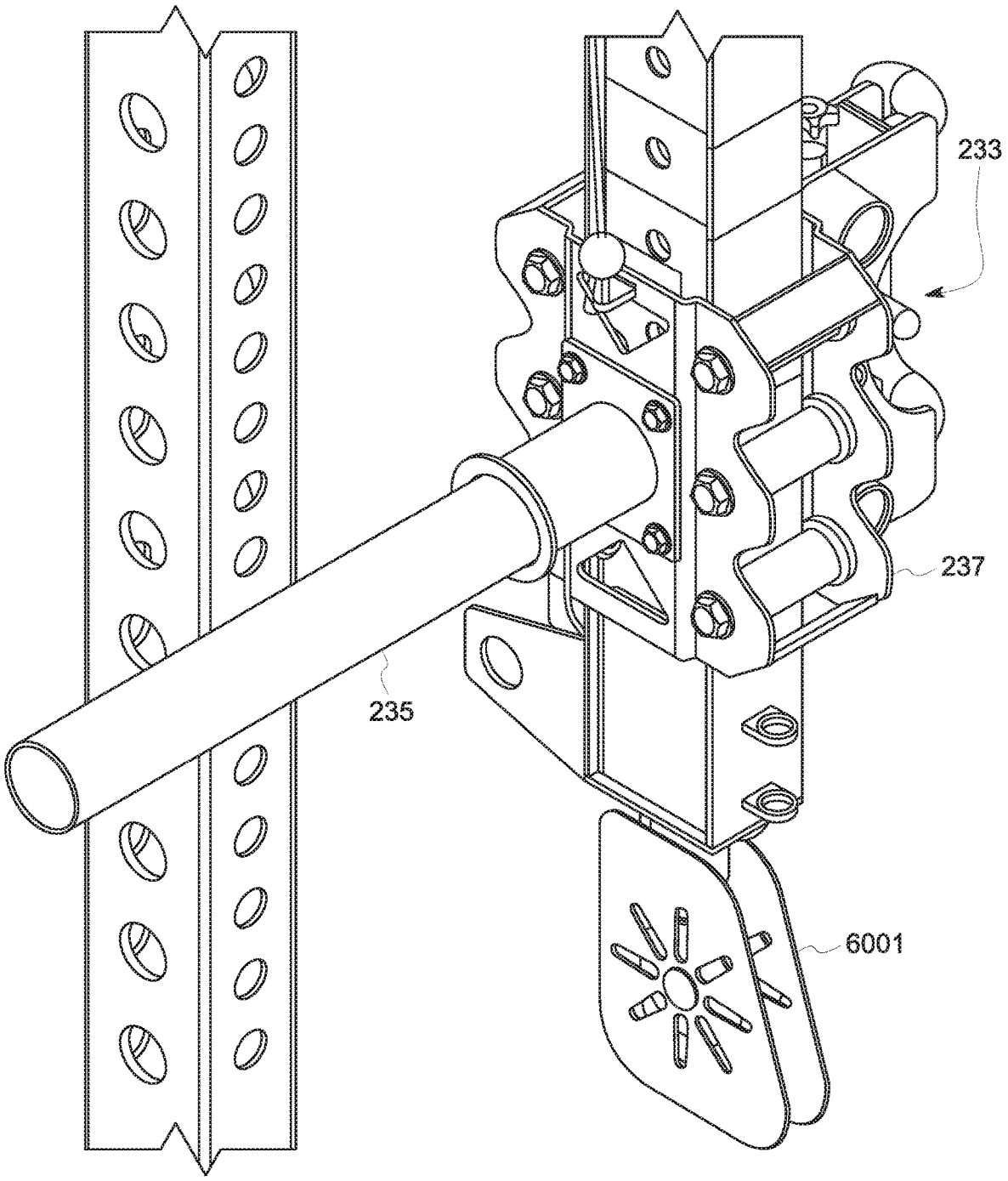
FIG. 6 is a close up of a grip support of the system of FIG. 2.

In FIG. 6, a closer view of the grip support 233 is shown. As shown, the grip support may also include a cable channel 6001.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An exercise system, comprising:

a frame, the frame having a vertical post with a plurality of adjustment holes extending therethrough;

a lever arm attached to the vertical post via a carriage, the carriage configured to adjust up and down in a vertical direction relative to a ground surface via the plurality of adjustment holes;

the carriage having:

a brace creating a channel to engage with the vertical post, the brace is configured to traverse an elongated length of the vertical post in a direction vertical to the ground surface;

a pivoting system extending from the brace, the pivoting system having:

a side to side pivoting connection attached to a second brace, the side to side pivoting connection allowing for the second brace to pivot in a horizontal direction relative to the ground surface;

a rotating connection attached to the second brace via a first plate and the lever arm via a second plate, the rotating connection allowing for rotational movement of the lever arm, the second plate rotates relative to the first plate and secured in a locked position via a knob;

the lever arm extends from a first end to a second end, the first end is attached to the second plate;

a cable support is secured to the first end of the lever arm;

wherein the carriage allows for the lever arm to be adjusted vertically, from side to side, and in a pivoting direction as needed for attachment of one or more exercise attachments.

2. The system of claim 1, further comprising:

a grip support engaged with the lever arm opposite the carriage, the grip support having a grip for user engagement.

3. The system of claim 2, wherein the grip support is vertically adjustable.

4. The system of claim 1, wherein the lever arm further comprises:

a protrusion extending from the lever arm, the protrusion configured to engage with the one or more exercise attachments.

5. The system of claim 1, the cable system is configured to engage with the one or more exercise attachments.

6. The system of claim 1, further comprising:

a handle extending from the first brace to provide for user adjustment of the lever arm.

7. The system of claim 1, wherein the carriage further comprises:

a first knob configured to engage with the plurality of adjustment holes for vertically adjusting the lever arm.

* * * * *